US011903422B2

(12) United States Patent
Mironov et al.

(10) Patent No.: US 11,903,422 B2
(45) Date of Patent: Feb. 20, 2024

(54) AEROSOL-GENERATING DEVICE FOR USE WITH AN AEROSOL-GENERATING ARTICLE COMPRISING MEANS FOR ARTICLE IDENTIFICATION

(71) Applicant: Philip Morris Products S.A., Neuchatel (CH)

(72) Inventors: Oleg Mironov, Neuchatel (CH); Jerome Christian Courbat, Neuchatel (CH); Enrico Stura, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 554 days.

(21) Appl. No.: 17/268,218

(22) PCT Filed: Aug. 16, 2019

(86) PCT No.: PCT/EP2019/071995

§ 371 (c)(1),
(2) Date: Feb. 12, 2021

(87) PCT Pub. No.: WO2020/035587

PCT Pub. Date: Feb. 20, 2020

(65) Prior Publication Data

US 2021/0315277 A1 Oct. 14, 2021

(30) Foreign Application Priority Data

Aug. 17, 2018 (EP) ..... 18189540

(51) Int. Cl.
*A24F 40/465* (2020.01)
*A24F 40/53* (2020.01)
*A24F 40/51* (2020.01)

(52) U.S. Cl.
CPC ..... *A24F 40/465* (2020.01); *A24F 40/51* (2020.01); *A24F 40/53* (2020.01)

(58) Field of Classification Search
CPC ..... A24F 40/465; A24F 40/53; A24F 40/40; A24F 40/51
(Continued)

(56) References Cited

U.S. PATENT DOCUMENTS 5,902,501 A 5/1999 Nunnally et al.
10,820,629 B1 * 11/2020 O'Connell ..... A24F 40/10
(Continued)

FOREIGN PATENT DOCUMENTS

JP 2012-513750 A 6/2012
JP 2017-515488 A 6/2017
(Continued)

OTHER PUBLICATIONS

International Search Report and Written Opinion dated Nov. 20, 2019 in PCT/EP2019/071995 filed on Aug. 16, 2019.
(Continued)

*Primary Examiner* — Alexander Gilman
(74) *Attorney, Agent, or Firm* — Oblon, McClelland, Maier & Neustadt, L.L.P.

(57) ABSTRACT

An electrically heatable aerosol-generating device for an aerosol-generating article is provided, the device including a device housing including a receiving cavity within a proximal portion of the device to receive at least a portion of the aerosol-generating article; a separating wall disposed adjacent to a distal end of the cavity, separating the cavity within the proximal portion from a distal portion of the device; at least one electrical heating device configured to heat an aerosol-forming substrate within the article when the article is received in the cavity; and sensing circuitry including a field generator disposed within the distal portion adjacent to the separating wall, the sensing circuitry being configured to measure a change of at least one property of the field generator caused by a presence of an indicator
(Continued)

arranged within the article when the article is received in the cavity. An aerosol-generating system is also provided.

17 Claims, 4 Drawing Sheets

(58) Field of Classification Search
USPC ..... 131/329
See application file for complete search history.

(56) References Cited

U.S. PATENT DOCUMENTS

| | | | | |
|---|---|---|---|---|
| 10,897,929 | B2 * | 1/2021 | Jochnowitz | A24F 40/53 |
| 10,918,136 | B2 * | 2/2021 | Reevell | H05B 1/0244 |
| 10,952,473 | B2 * | 3/2021 | Bessant | G01F 23/263 |
| 11,013,268 | B2 * | 5/2021 | Bessant | H05B 1/0227 |
| 11,099,213 | B2 * | 8/2021 | Gaggl | G01R 15/005 |
| 11,134,722 | B2 * | 10/2021 | Verleur | H02J 7/00 |
| 11,622,579 | B2 * | 4/2023 | Lim, II | H05B 3/20 131/329 |
| 2010/0163063 | A1 | 7/2010 | Fernando et al. | |
| 2011/0113878 | A1 * | 5/2011 | Ohshima | G01F 23/266 73/304 C |
| 2014/0196736 | A1 | 7/2014 | Fernando et al. | |
| 2016/0029698 | A1 * | 2/2016 | Xiang | A24F 40/65 131/328 |
| 2016/0235122 | A1 * | 8/2016 | Krietzman | A24B 15/16 |
| 2016/0374402 | A1 | 12/2016 | Fernando et al. | |
| 2017/0027233 | A1 | 2/2017 | Mironov | |
| 2017/0055589 | A1 | 3/2017 | Fernando et al. | |
| 2017/0095003 | A1 | 4/2017 | Mironov | |
| 2017/0135404 | A1 | 5/2017 | Reevell | |
| 2017/0196269 | A1 | 6/2017 | Bernauer et al. | |
| 2018/0049469 | A1 * | 2/2018 | Kaufman | A24B 15/16 |
| 2018/0177238 | A1 * | 6/2018 | Bessant | G01C 9/18 |
| 2018/0242644 | A1 * | 8/2018 | Bessant | H05B 3/34 |
| 2018/0317561 | A1 | 11/2018 | Mironov | |
| 2019/0182909 | A1 | 6/2019 | Fursa et al. | |
| 2020/0229508 | A1 * | 7/2020 | Israel | A24F 40/65 |
| 2020/0260790 | A1 * | 8/2020 | Kaufman | A24F 40/50 |
| 2021/0315279 | A1 * | 10/2021 | Mironov | A24F 40/20 |

FOREIGN PATENT DOCUMENTS

| | | | |
|---|---|---|---|
| KR | 10-2016-0111902 | A | 9/2016 |
| RU | 2 642 520 | C2 | 1/2018 |
| RU | 2 643 421 | C2 | 2/2018 |
| WO | WO 99/20940 | A1 | 4/1999 |
| WO | WO 2010/073122 | A1 | 7/2010 |
| WO | WO 2015/177247 | A1 | 11/2015 |
| WO | WO 2017/084848 | A1 | 5/2017 |
| WO | WO 2018/041450 | A1 | 3/2018 |

OTHER PUBLICATIONS

Combined Russian Office Action and Search Report dated Dec. 21, 2022 in Russian Patent Application No. 2021106778 (with English Translation), 11 pages.

Japanese Office Action dated Jul. 6, 2023 in Japanese Patent Application No. 2021-507781 (with English Transiation), 5 pages.

Combined Chinese Office Action and Search Report dated Jun. 20, 2023 in Chinese Patent Application No. 201980052999.5 (with English Translation), 11 pages.

* cited by examiner

AEROSOL-GENERATING DEVICE FOR USE WITH AN AEROSOL-GENERATING ARTICLE COMPRISING MEANS FOR ARTICLE IDENTIFICATION

The present invention relates to an electrically heated aerosol-generating device for use with an aerosol-generating article comprising means for article identification.

Aerosol-generating systems based on electrically heating aerosol-forming substrates are generally known from prior art. Typically, these systems comprise two components: an aerosol-generating article including the aerosol-forming substrate to be heated, and an aerosol-generating device, wherein the device comprises a receiving cavity for receiving the article and an electrical heater, for example a resistive or an inductive heater, for heating the substrate within the article when the article is inserted into the receiving cavity.

Typically, each electrically heated aerosol-generating device is designed for use with a specific type of an aerosol-generating article. This is due to the unique design of each aerosol-generating system that is defined by the specific type of substrate and its specific requirements for a well-controlled heating process. Otherwise, using an article with an aerosol-generating device which the article is not explicitly designed for may provide a different smoking experience for the user. In particular, using non-suitable articles may lead to overheating of the aerosol-forming substrate, thus causing an undesired combustion of the substrate. Even more, using articles which are non-compatible with a specific type of device may also damage the system.

Though there are aerosol-generating systems comprising means that are configured to identify compatible articles and to prevent usage of non-compatible articles, such means often are susceptible to faults, in particular fault detection such that articles actually suitable are not recognized or identified properly. Also, there are means for article identification which may be easily circumvented, both intentionally and non-intentionally.

Therefore, it would be desirable to have an aerosol-generating device for use with an aerosol-generating article, including improved means for article identification, in particular which provide increased difficulty to use non-compatible or counterfeit articles with the device.

According to the invention there is provided an electrically heating aerosol-generating device for use with an aerosol-generating article, wherein the article includes an aerosol-forming substrate to be heated by the device. The device comprises a device housing including a receiving cavity within a proximal portion of the device for receiving at least a portion of the aerosol-generating article. The device further comprises a separating wall arranged adjacent to a distal end of the receiving cavity, wherein the separating wall separates the receiving cavity within the proximal portion of the device from a distal portion of the device. The device further comprises at least one electrical heating device for heating the aerosol-forming substrate within the article when the article is received in the receiving cavity. Furthermore, the device comprises a sensing circuitry comprising a field generator. The sensing circuitry is configured to measure a change of at least one property of the field generator caused by the presence of an indicator arranged at or within the article when the article is received in the receiving cavity. According to the invention, the field generator is arranged within the distal portion of the device adjacent to the separating wall.

According to the invention it has been recognized that for many aerosol-generating devices known from prior art fault article detection is caused by disadvantageous arrangement of the identification means within the device. For example, in case the identification means are arranged about the entrance of the receiving cavity—which typically is located at the very proximal end of the device—article identification is likely to be susceptible to external influences, such as stray electromagnetic fields originating from parasitic field source in the surroundings of the device. This is particularly true for identification means based on electromagnetic induction. These may be, for example, identification means including induction coils configured to measure a change of an inductance caused by the presence of an inductive indicator within the article when the article is received in the receiving cavity. Using such means, parasitic electromagnetic fields may cause adverse induction effects in the induction coil causing article identification, even of suitable articles, to fail. As to this, article identification becomes less reliable the more the induction coil is exposed to such parasitic field sources.

For this reason, the field generator according to the present invention is arranged in the distal portion of the device, in particular close to or adjacent to the separating wall. Advantageously, this arrangement provides sufficient shielding of the field generator from stray electromagnetic fields by the device itself. Accordingly, a disturbance of the field generated by the field generator when the article is introduced into the receiving cavity occurs in a well-shielded area under stable, that is, reproducible electromagnetic conditions.

In addition, arrangement of the field generator in the distal portion of the device allows a complete shielding of the field generator from the harsh environments in the receiving cavity, in particular high temperatures, humidity and aerosol particles. Thus, deposits on the field generator and/or possible corrosion of the electrical parts of the field generator can be effectively prevented.

As a result, the aerosol-generating device according to the present invention allows for article identification that is significantly improved as compared to other devices known from prior art.

According to the invention, the separating wall is arranged adjacent to a distal end portion (or bottom portion) of the receiving cavity. Accordingly, the separating wall separates a proximal portion of the device from a distal portion of the device, wherein the proximal portion may include the receiving cavity. The separating wall may have a rectangular cross-section or an oval cross-section or circular cross-section as seen in a direction along a center axis of the receiving cavity or along an overall length extension of the device. Preferably, the cross-section of the separating wall corresponds to the shape of the cross-section of the receiving cavity or to an overall cross-section of the heating device.

Preferably, the separating wall sealingly separates the receiving cavity from the distal portion of the device. For this, the device may comprise sealing means, such as a gasket, in particular an O-ring, arranged along the perimeter or outer circumference of the separating wall. Preferably, the separating wall may be a bushing (electrical bushing), that is, an insulating member allowing to hold or pass through parts of an electrical conductor, for example, parts of the electrical heating device.

In general, the field generator may be of any type and may have any configuration, shape and arrangement within the device housing suitable to sense the presence of the indicator arranged at or within the article when the article is introduced into the receiving cavity.

As used herein, the term "field generator" refers to an apparatus which is able to act as a source for a field, that is, the field generator may be configured to generate a field. Accordingly, the field generator may also be denoted as field source. The field may be an electrical field, a magnetic field, or an electromagnetic field. The field generator may comprise, for example, an induction coil, an antenna, or a magnet, in particular an electromagnet or a permanent magnet.

The field generator is preferably an induction coil. Where this is the case, the induction coil may be a helical coil or a flat spiral coil, in particular a pancake coil or a flat curved spiral coil. Use of a flat spiral coil allows for compact design that is robust and inexpensive to manufacture. Use of a helical induction coil advantageously provides a substantially homogeneous field configuration in the interior of the coil. As used herein a "flat spiral coil" means a coil that is a generally planar coil, wherein the axis of winding of the coil is normal to the surface in which the coil lies. The flat spiral induction can have any desired shape within the plane of the coil. For example, the flat spiral coil may have a circular shape or may have a generally oblong or rectangular shape. However, the term "flat spiral coil" as used herein covers both, coils that are planar as well as flat spiral coils that are shaped to conform to a curved surface. For example, the induction coil may be a "curved" planar coil arranged at the circumference of a preferably cylindrical coil support, for example ferrite core. Furthermore, the flat spiral coil may comprise for example two layers of a four-turn flat spiral coil or a single layer of four-turn flat spiral coil. In order to prevent deposits on the induction coil and/or possible corrosion, the induction coil may comprise a protective cover or layer.

The indicator presence of the indicator near to the field generator causes a disturbance in the field generated by the field generator. The disturbance in the field affects the field generator which leads to a change of the at least one property of the field generator. The change of the property may be observed by measuring a change in a parameter of the field generator. The parameter may be measured either directly or indirectly. The presence of the indicator, and therefore the article, may be determined by measuring the parameter and observing that the parameter has a different value in the presence of the indicator compared to the value in the absence of the indicator.

The disturbance in the field generated by the field generator caused by the presence of the indicator may be due to an interaction between the field and the indicator.

The indicator within the aerosol-generating article may have a specific magnetic permeability and a specific electrical resistivity. That is, the indicator may include a material having a specific magnetic permeability and a specific electrical resistivity. Preferably, the indicator comprises an electrically conductive material. For example, the indicator may comprise a metallic material. The metallic material may be, for example, one of aluminum, nickel, iron, or alloys thereof, for example, carbon steel or ferritic stainless steel. Aluminum has an electrical resistivity of about 2.65×10E-08 Ohm-meter, measured at room temperature (20° C.), and a magnetic permeability of about 1.256×10E-06 Henry per meter. Likewise, ferritic stainless steel has an electrical resistivity of about 6.9×10E-07 Ohm-meter, measured at room temperature (20° C.), and a magnetic permeability in a range of 1.26×10E-03 Henry per meter to 2.26×10E-03 Henry per meter.

The at least one property of the field generator may be any property which has an associated parameter which has a different value in the presence of the indicator compared to the value in the absence of the indicator. For example, the at least one property may be current, voltage, resistance, frequency, phase shift, flux, and inductance of the field generator. Preferably the property is the inductance of the field generator.

The indicator may be an inductive indicator.

Inductance, generally speaking, includes the property of an electric circuit to be susceptible to exterior electromagnetic influences. As used herein, the term "inductance" as measured by the sensing circuitry refers to the imaginary part of a complex impedance defined as the ratio of the supplied AC voltage to the measured AC current.

In order to concentrate the sensing field of the field generator to a volume where the effect of the indicator on the at least one property of the field generator is at maximum, the device may comprise a magnetic flux concentrator, wherein at least a portion of the magnetic flux concentrator is circumferentially surrounded by at least a part or portion of the field generator and arranged within the distal portion of the device adjacent to the separating wall. Moreover, using a magnetic flux concentrator may help to reduce disturbing effects on measuring the at least one property, for example an inductance. Such disturbing effects may particularly result from the device housing.

Preferably, the magnetic flux concentrator extends at least into the separating wall. Advantageously, this facilitates to have the sensing field of the field generator closer to the indicator when the article is arranged within the receiving cavity. A distal end of the magnetic flux concentrator may end within the separating wall without reaching the surface of the separating wall that faces the receiving cavity. Advantageously, the latter configuration facilitates shielding of the field generator and electronics from the harsh environments in the receiving cavity.

Alternatively, the magnetic flux concentrator may extend through, that is, beyond the separating wall into the proximal portion of the device. This configuration facilitates to have the sensing field of the field generator even closer to the indicator when the article is arranged within the receiving cavity.

A thickness of a portion of the separating wall accommodating the magnetic flux concentrator or being adjacent to the magnetic flux concentrator may be smaller than a thickness of other portions of the separating wall. Advantageously, this may help to improve the sensitivity of the field generator to the indicator within the article.

The magnetic flux concentrator preferably comprises or consists of a ferrimagnetic material, in particular a metallic ferrite such as soft iron or silicon, steel (transformer steel), or permalloy. The magnetic flux concentrator may be a cylinder, having for example a rectangular, quadratic, circular or oval cross-section.

Furthermore, the magnetic flux concentrator—at least a portion of which is circumferentially surrounded by the field generator—may be arranged off-center with regard to a center axis of the receiving cavity. This arrangement may also improve the sensitivity of the field generator to the indicator within the article.

According to a further aspect of the invention, the device may comprise a controller which is operatively coupled with the sensing circuitry. The controller may be configured to control operation of the heating device based on a comparison of the measured change of the at least one property of the field generator, such as an inductance, with one or more predetermined values of change of the at least one property. Accordingly, operation of the heating device is activated by the controller only in case the measured of the at least one property corresponds to a predetermined value, or at least is within a respective pre-defined range of acceptability around the predetermined value. Otherwise, in case the at least one property is not verified, operation of the heating device is not activated. Thus, usage of non-compatible articles may be effectively prevented.

Preferably, the sensing circuitry is further configured to measure a change of at least two properties, in particular two properties of the field generator caused by the presence of the indicator of the article when the article is received in the receiving cavity. For, the sensing circuitry may be configured to measure a change of an equivalent resistance as well as a change of an inductance of the field generator caused by the presence of the indicator of the article. As used herein, the term "equivalent resistance" refers to the real part of a complex impedance defined as the ratio of the supplied AC voltage to the measured AC current.

In this configuration, the controller advantageously is configured to control operation of the heating device based on a comparison of the measured changes of the at least two properties of the field generator, for example of an inductance and a resistance of the field generator, with one or more predetermined values of change of the respective properties. As to this, it has been recognized that protection against undesired usage of non-compatible or counterfeit articles can be further increased by measuring and verifying the change of at least two properties of the field generator caused by the presence of the indicator (instead of one property only), that is, by measuring and verifying the effect of at least two parameters of the indicator on the field generator. Hence, operation of the heating device is activated by the controller only in case the respective changes of all of the at least two measured properties of the field generator are verified, that is, coincidentally correspond to the respective predetermined values, or at least are coincidently within a respective pre-defined range of acceptability around the predetermined values. Otherwise, in case at least one of the measured changes is not verified, operation of the heating device is not activated. The measured changes of the at least two properties of the field generator, for example the change of the equivalent inductance and the change of the equivalent resistance, thus form a set of properties, for example a property pair, to be coincidently verified.

Preferably, the set of properties is unique to the use of a specific indicator with the article. In particular, the indicator may have a specific magnetic permeability and a specific electrical resistivity. Accordingly, the specific magnetic permeability and the specific electrical resistivity may form a unique parameter set such that there preferably is only one indicator material exhibiting the specific values of these parameters which exclusively is capable of inducing the predetermined changes of properties of the field generator, such as a predetermined change of its inductance and equivalent resistance. The predetermined changes of properties of the field generator may result from a calibration measurement and generally depend—in addition to the physical properties of the indicator, such as for example its magnetic permeability and electrical resistivity—from the geometric configuration of the indicator and the field generator as well as from the arrangement of the indicator relative to the field generator. Hence, apart from the geometry and relative arrangement of the indicator and the field generator, there is preferably a unique effect by the physical properties of the indicator to characteristic changes of specific properties of the field generator. For example, there may be a unique effect by the magnetic permeability and electrical resistivity of the indicator on the change of the inductance and the equivalent resistance of the field generator. Accordingly, there is preferably a unique relationship between a parameter set of physical properties of the indicator, such as the magnetic permeability and electrical resistivity, and a set of properties of the field generator, such as the change of inductance and change of equivalent resistance of the field generator. This unique relationship advantageously makes the identification or recognition of a genuine aerosol-generating article more reliable.

As used herein, the term "aerosol-generating device" is used to describe an electrically operated device that is capable of interacting with at least one aerosol-forming substrate, in particular with an aerosol-forming substrate provided within an aerosol-generating article, such as to generate an aerosol by heating the substrate. Preferably, the aerosol-generating device is a puffing device for generating an aerosol that is directly inhalable by a user thorough the user's mouth. In particular, the aerosol-generating device is a hand-held aerosol-generating device.

As used herein, the term "aerosol-generating article" refers to an article comprising at least one aerosol-forming substrate that, when heated, releases volatile compounds that can form an aerosol. Preferably, the aerosol-generating article is a heated aerosol-generating article. That is, an aerosol-generating article which comprises at least one aerosol-forming substrate that is intended to be heated rather than combusted in order to release volatile compounds that can form an aerosol. The aerosol-generating article may be a consumable, in particular a consumable to be discarded after a single use. For example, the article may be a cartridge including a liquid aerosol-forming substrate to be heated. Alternatively, the article may be a rod-shaped article, in particular a tobacco article, resembling conventional cigarettes.

As used herein, the term "aerosol-forming substrate" relates to a substrate capable of releasing volatile compounds that can form an aerosol upon heating the aerosol-forming substrate. The aerosol-forming substrate is part of the aerosol-generating article. The aerosol-forming substrate may be a solid or a liquid aerosol-forming substrate. In both cases, the aerosol-forming substrate may comprise at least one of solid and liquid components. The aerosol-forming substrate may comprise a tobacco-containing material containing volatile tobacco flavor compounds, which are released from the substrate upon heating. Alternatively or additionally, the aerosol-forming substrate may comprise a non-tobacco material. The aerosol-forming substrate may further comprise an aerosol former. Examples of suitable aerosol formers are glycerine and propylene glycol. The aerosol-forming substrate may also comprise other additives and ingredients, such as nicotine or flavourants. The aerosol-forming substrate may also be a paste-like material, a sachet of porous material comprising aerosol-forming substrate, or, for example, loose tobacco mixed with a gelling agent or sticky agent, which could include a common aerosol former such as glycerine, and which is compressed or molded into a plug.

The sensing circuitry including the field generator may be an oscillator circuitry.

The electrical heating device preferably is a resistive heating device comprising a resistive heating element. The resistive heating element heats up when electrical current is passed through due to its immanent ohm resistance or resistive load. The resistive heating element may comprise at least one of a resistive heating wire, a resistive heating track, a resistive heating grid or a resistive heating mesh. Preferably, the heating device comprises a heating blade fixedly arranged within the receiving cavity, extending substantially along a center axis of the receiving cavity. The blade may comprise a tapered proximal tip portion at its proximal end facing towards to an opening of the receiving cavity at a proximal end of the device. Thus, upon inserting the article into the receiving cavity, the heating blade may readily penetrate into the aerosol-forming substrate of the article. For heating the substrate, at least one side of the heating blade may be coated with a metal track, for example made of platinum, serving as resistive heating element. Thus, when passing a driving current through the metal track the heating blade heats causing volatile compounds in the aerosol-forming substrate to be heated and released such as to form an aerosol.

The controller of the aerosol-generating device used to control the heating process may be an overall controller. In particular, the controller may be configured to control the temperature of the aerosol-forming substrate, in particular to adjust the temperature of the aerosol-forming substrate to a target temperature. As to this, the controller may be configured to regulate a supply of current to the heating device. Current may be supplied to the heating device continuously following activation of the system or may be supplied intermittently, such as on a puff by puff basis.

The controller may comprise a microprocessor, for example a programmable microprocessor, a microcontroller, or an application specific integrated chip (ASIC) or other electronic circuitry capable of providing control. The controller may comprise further electronic components, such as at least one DC/AC inverter and/or power amplifiers, for example a Class-D or Class-E power amplifier.

In particular, the controller may include the sensing circuitry. As to this, the controller may be configured to run and read out the sensing circuitry The aerosol-generating device advantageously comprises a power supply, preferably a battery such as a lithium iron phosphate battery. As an alternative, the power supply may be another form of charge storage device such as a capacitor. The power supply may require recharging and may have a capacity that allows for the storage of enough energy for one or more user experiences. For example, the power supply may have sufficient capacity to allow for the continuous generation of aerosol for a period of around six minutes or for a period that is a multiple of six minutes. In another example, the power supply may have sufficient capacity to allow for a predetermined number of puffs or discrete activations of the heating device. Preferably, the aerosol-generating device comprises at least one air inlet in fluid communication with the receiving cavity. Accordingly, the aerosol-generating system may comprise an air path extending from the at least one air inlet into the receiving cavity, and possibly further through the aerosol-forming substrate within the article and a mouthpiece into a user's mouth.

For removing the aerosol-forming substrate or aerosol-generating article after having been spent, the aerosol-generating device may further comprise an extractor—for example as described in WO 2013/076098 A2-for extracting the aerosol-forming substrate or aerosol-generating article received in the aerosol-generating device.

According to the invention, there is also provided an aerosol-generating system which comprises an electrically heated aerosol-generating device according to the invention and as described herein as well as an aerosol-generating article for use with the device.

The aerosol-generating article comprises an aerosol-forming substrate to be heated by the device upon insertion of the article into the receiving cavity of the device. Furthermore, the article includes an indicator that is configured to cause a change of at least one, preferably of at least two properties of the field generator when the article is received in the receiving cavity, for example a change an inductance of the field generator and preferably also a change of an equivalent resistance.

As mentioned above, the indicator may include a material having a specific magnetic permeability and a specific electrical resistivity. Preferably, the indicator includes a metallic indicator material. The metallic indicator material may be, for example, one of aluminum, nickel, iron, or alloys thereof, for example, carbon steel, or ferritic stainless steel. Aluminum has an electrical resistivity of about 2.65×10E-08 Ohm-meter, measured at room temperature (20° C.), and a magnetic permeability of about 1.256×10E-06 Henry per meter. Likewise, ferritic stainless steel has an electrical resistivity of about 6.9×10E-07 Ohm-meter, measured at room temperature (20° C.), and a magnetic permeability in a range of 1.26×10E-03 Henry per meter to 2.26×10E-03 Henry per meter.

The indicator may have any shape and/or configuration. For example, the indicator may comprise at least one of a wire, a particle, a patch, a ring, a shred, a filament, and a strip of a material which causes a disturbance in a field generated by the field generator. Preferably, the indicator is arranged close to the outer surface of the article. For example, the indicator may be a sleeve or wrapper or envelop surrounding at least a portion of the aerosol-forming substrate.

Preferably, the indicator is arranged at least within a distal portion of the article, opposite to a proximal portion of the article which preferably comprise a mouthpiece, in particular filter plug. Of course, the indicator may be arranged along the entire length extension of the article or exclusively within a distal portion of the article.

In general, the article may have a substantially rod shape, preferably resembling the shape of conventional cigarettes.

The article may comprise different portions, in particular an aerosol-forming substrate at a proximal end portion of the article, a support element having a central air passage, an aerosol-cooling element, and a filter plug at a distal end of the article which serves as a mouthpiece.

The article may further comprise a wrapper surrounding at least a portion of the aerosol-forming substrate or surrounding the different portions mentioned above such as to keep them together and to maintain the desired cross-sectional shape of the article. Preferably, the wrapper forms at least a portion of the outer surface of the article. For example, the wrapper may be a paper wrapper, in particular a paper wrapper made of cigarette paper. Alternatively, the wrapper may be a foil, for example made of plastics. The wrapper may be fluid permeable such as to allow vaporized aerosol-forming substrate to be released from the article, or to allow air to be drawn into the article through its circumference. Furthermore, the wrapper may comprise at least one volatile substance to be activated and released from the wrapper upon heating. For example, the wrapper may be impregnated with a flavoring volatile substance.

Preferably, the wrapper includes the indicator or the indicator is arranged at or attached to the wrapper. In particular, the indicator itself may be a wrapper attached to the wrapper which forms at least a portion of the outer surface of the article. Preferably, the indicator is arranged or attached to the inner surface of such a wrapper. For example, the indicator may comprise a sleeve including an indicator material, which surrounding at least a portion of the aerosol-forming substrate and or extends along at least a portion of the length extension of the article. Likewise, the indicator may comprise a thin film or foil made of an indicator material that is applied to at least a portion of the inner surface of a wrapper which forms at least a portion of the outer surface of the article. Preferably, the metallic indicator material is applied to the inner surface of the wrapper, for example paper wrapper, within a distal portion of the article. The indicator material may be metal, for example aluminum. In this configuration, the wrapper may be considered as a metallized wrapper, in particular as an aluminized wrapper.

Furthermore, the indicator preferably forms a closed loop electrically conductive path around the circumference of the article. For example, the indicator may form a wrapper which fully circumscribes at least a portion of the article. Advantageously, this causes the measured changes of the inductance and resistance to be more pronounced and thus article identification to be more reliable. Advantageously, this also allows the disturbance in the field generated by the field generator caused by the indicator, and the corresponding change in the at least one property, to be independent of the axial rotational orientation of the article relative to the device.

The invention will be further described, by way of example only, with reference to the accompanying drawings, in which.

Figure 1:
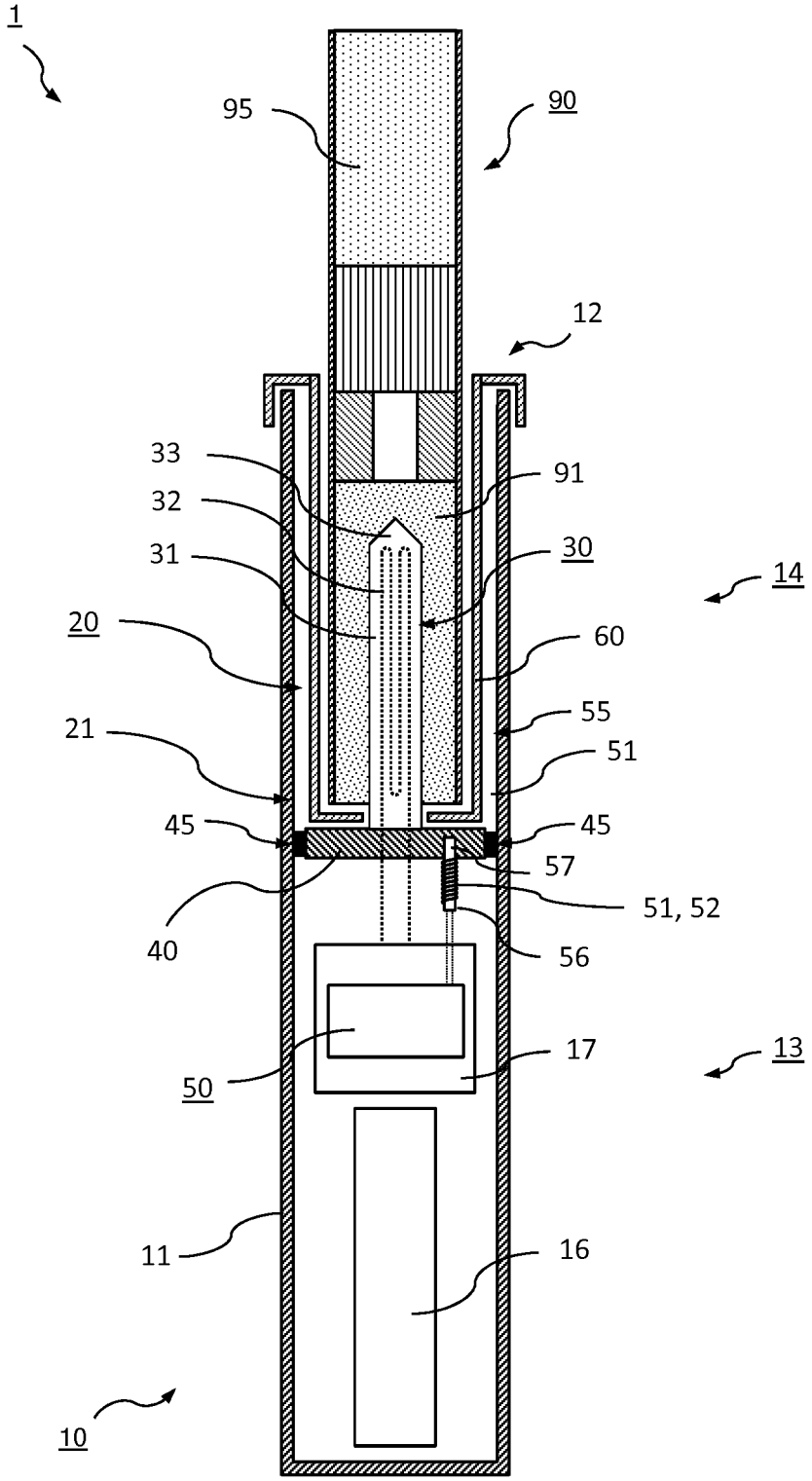
FIG. 1 is a schematic illustration of an aerosol-generating system according to a first embodiment of the present invention, comprising an aerosol-generating device and an aerosol-generating system.
Figure 2:
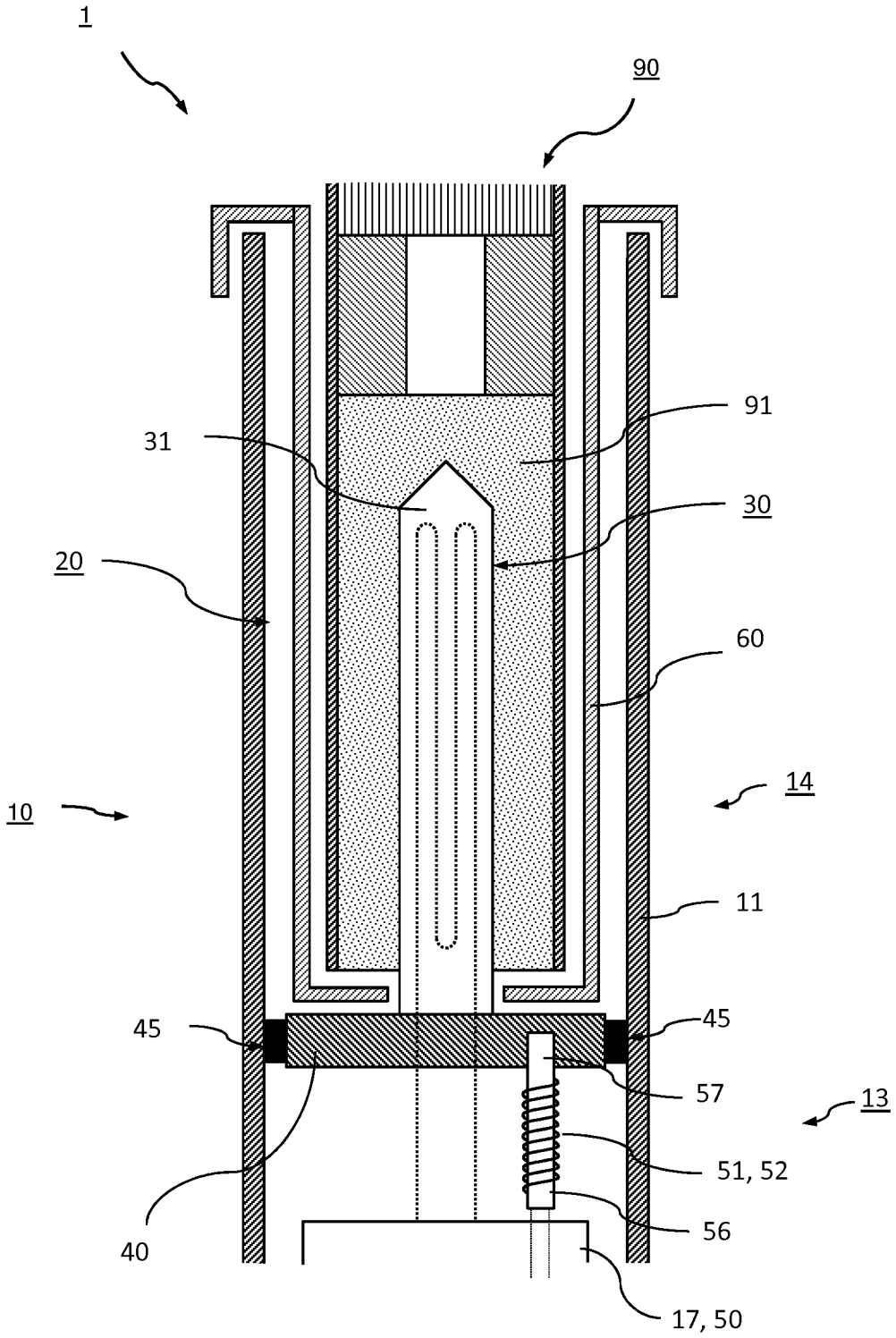
FIG. 2 is a detailed schematic illustration of an aerosol-generating system of the aerosol-generating system according to FIG. 1.

FIG. 1 and FIG. 2 schematically illustrate an aerosol-generating system 1 according to a first embodiment of the present invention that is configured to electrically heat an aerosol-forming substrate 91 such as to generate an aerosol. The system 1 comprises two components: an aerosol-generating article 90 including the aerosol-forming substrate 91 to be heated, and an aerosol-generating device 10 for use with the article 90 which comprises a receiving cavity 20 for receiving the article 90, and an electrical heating device 30 that is configured to heat the aerosol-forming substrate 91 within the article 90 when being inserted into the receiving cavity 20.

As can be seen from FIG. 1, the device 10 comprises a substantially rod-shaped device body formed by a substantially cylindrical device housing 11. Within a distal portion 13, the device 10 comprises a power supply 16, for example a lithium ion battery, as well as an electric circuitry 17 including a controller 18 for controlling operation of the device 10, in particular for controlling substrate heating. Within a proximal portion 14 opposite to the distal portion 13, the device 10 comprises the receiving cavity 20. The receiving cavity 20 is open-ended at the proximal end 12 of device 10, thus allowing the article 90 to be readily inserted into the receiving cavity 20.

As can be further seen from FIG. 1, the device 10 comprises a separating wall 40 that is arranged within the device housing 11. The separating wall 40 sustainably separates the receiving cavity 20 in the proximal portion 14 of the device 10 from the electronic parts in the distal portion 13 of the device 10. In the present embodiment, the separating wall 40 also serves as bushing enabling to hold and pass through parts of the electrical heating device 30. As to this, the separating wall 40 is made of an electrically insulating material. Preferably, the material of the separating wall 40 is also thermally insulating such as to prevent heat transfer from the receiving cavity 20 to the electronic parts in the distal portion 13 of the device 10. Accordingly, the separating wall 40 may be, for example, made of a thermally insulating plastic material, such as PEEK (polyether ether ketone).

To ensure proper protection of the electronic parts in the distal portion 13 of the device 10 from dust and humidity, the device 10 further comprises sealing means 45, such as a gasket, which are arranged along the perimeter of the separating wall 40.

The heating device 30 according to the present embodiment is a resistive heating device. With reference to FIG. 1, the heating device 30 comprises a heating blade 31 comprising a metallic core sandwiched between two ceramic cover members. The blade is mounted to the separating wall 40 and thus fixedly arranged within the device housing 11. From the separating wall 40, the blade 31 extends into the receiving cavity 20, substantially along a center axis of the receiving cavity 20. A tapered proximal tip portion 33 at the proximal end of the heating blade 31 faces towards to opening of the cavity 20 at the proximal end 12 of the device 10. Thus, upon inserting the article 90 into the receiving cavity 20, the heating blade 31 penetrates into the aerosol-forming substrate 91 in the distal tip end portion of the article 90. For heating the substrate, the outer surface of at least one cover member is coated with a metal track 32, for example made of platinum, serving as resistive heating element which is operatively coupled to the power supply 16 and the controller 17 for powering and controlling the resistive heating process. Thus, when passing the driving current through the metal track 32 the heating blade 31 heats causing volatile compounds in the aerosol-forming substrate 91 to be heated and released such as to form an aerosol.

For removing the aerosol-generating article 90 after having been spent, the aerosol-generating device 10 further comprises an extractor 60—for example an extractor as described in WO 2013/076098 A2—which is arranged within the receiving cavity 20 and configured to facilitate extraction of the article 90 from the heating blade 31.

Figure 3:
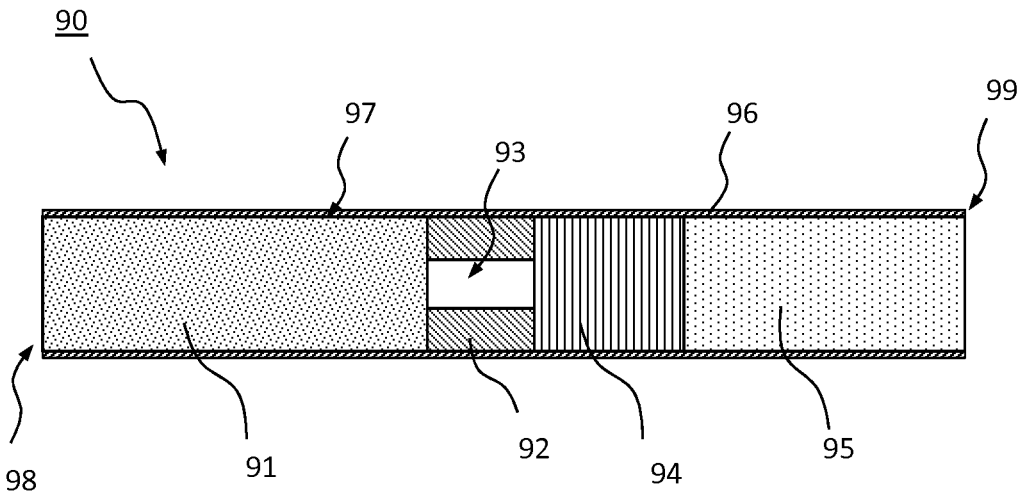
FIG. 3 is a detailed illustration of the aerosol-generating article according to FIG. 1.

FIG. 3 illustrates the aerosol-generating article 90 according to FIG. 1 and FIG. 2 in more detail. The article 90 substantially has a rod shape resembling the shape of a conventional cigarette. The article 90 comprises four elements arranged in coaxial alignment: an aerosol-forming substrate 91 at a proximal end 98 of the article 90, a support element 92 having a central air passage 93, an aerosol-cooling element 94, and a filter plug 95 at a distal end 99 of the article 90 which serves as a mouthpiece. The aerosol-forming substrate 91 may include, for example, a crimped sheet of homogenized tobacco material including glycerin as an aerosol-former. The support element 92 comprises a hollow core forming a central air passage 93. The filter plug 95 may, for example, include cellulose acetate fibers. All four elements are substantially cylindrical elements, having substantially the same diameter. The four elements are arranged sequentially and circumscribed by an outer wrapper 96 made of cigarette paper such as to form a cylindrical rod. Further details of this specific aerosol-generating article, in particular of the four elements, are disclosed in WO 2015/176898 A1.

Yet, in contrast to the article disclosed in WO 2015/176898 A1, the article according to the present invention includes an indicator material 97 used for article recognition, that is, for identifying the genuineness of the article and for preventing usage of non-compatible or counterfeit articles. In the present embodiment, the metallic indicator material 97 is a thin film made of aluminum that is applied to the inner surface of the paper wrapper 96. Thus, the wrapper 96 may also be considered as an aluminized paper wrapper.

To identify the genuineness of an article and to preventing usage of non-compatible or counterfeit articles, the aerosol-generating device 10 comprises a sensing circuitry 50 including a field generator 52 in the form of an induction coil 51. The sensing circuitry 50 is configured to detect the presence of the indicator material 91 in the aerosol-generating article 90 when being positioned close to the induction coil 51 upon insertion of the article into the receiving cavity 20.

According to the present invention, the sensing circuitry 50 is configured to measure both, a change of the equivalent inductance ΔL_eq as well as a change of the equivalent resistance ΔR_eq of the induction coil 50 induced or caused by the indicator material 91 upon insertion of the aerosol-generating article 90 into the receiving cavity 20. Typically, the sensing circuitry 50 may include an oscillator circuitry for measuring both parameters.

Figure 4:
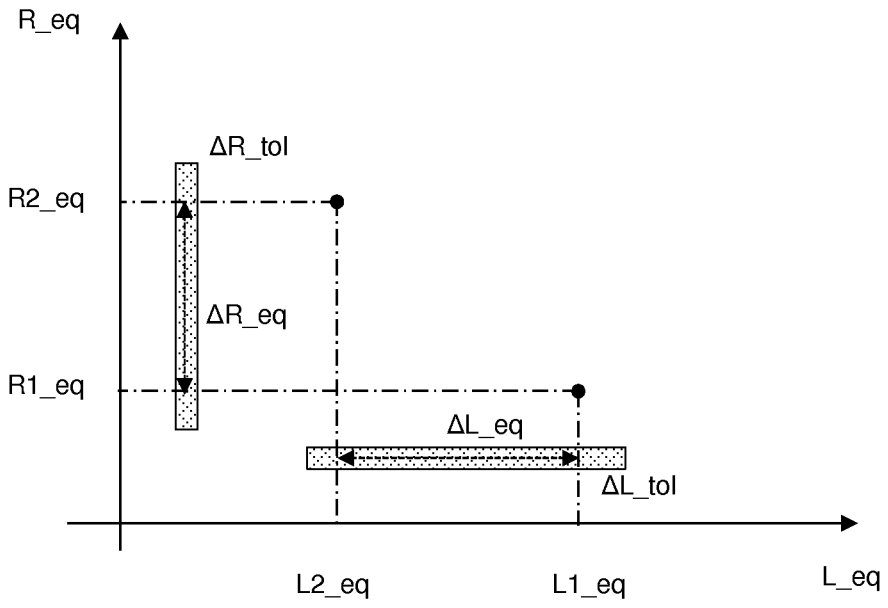
FIG. 4 is a diagram showing identification parameters measured by the aerosol-generating system according to the present invention.

As illustrated in FIG. 4, the induction coil 50—as part of the sensing circuitry 50—has an equivalent inductance L1_eq which decrease to a lower value L2_eq upon insertion of the aerosol-generating article 90 into the receiving cavity 20. This decrease is due to the specific magnetic permeability of the indicator material 97 changing the effective magnetic permeability within a space volume proximate the conductive coil 51. Likewise, the induction coil 50 experiences an increase of the equivalent resistance from R1_eq upon insertion of the aerosol-generating article 90 into the receiving cavity 20. This increase is due to the specific resistivity of the indicator material 97 which represents a resistive load applied to the induction coil 51. As described above, the induction coil 51 preferably is part of an oscillator circuitry 50. When the resistive indicator material 97 is positioned proximate the induction coil 51, the Q factor (quality factor) of the sensing circuitry is reduced. This causes a measurable voltage and current increase in the sensing circuitry such as to compensate for increased losses in the reactive load.

According to the invention, the sensing circuitry 50 is operatively coupled with the controller 17. In the present embodiment, the sensing circuitry 50 is even part of the controller 17. According to the invention, the controller is configured to control operation of the heating device 30 based on a comparison of the measured change of the equivalent inductance and equivalent resistance with one or more predetermined values of change of the equivalent inductance and equivalent resistance. In particular, operation of the heating device 30 is activated by the controller 17 only in case both measured parameters ΔL_eq and ΔR_eq coincidentally correspond to the respective predetermined values, or at least are coincidently within a respective predefined range of acceptability ΔL_tol and ΔR_tol around the predetermined values. Otherwise, in case at least one of the measured parameters ΔL_eq or ΔR_eq is not verified, operation of the heating device 30 is not activated. Both, the change of the equivalent inductance ΔL_eq and the change of the equivalent resistance ΔR_eq thus form a parameter pair to be verified that is unique to the use of a specific indicator material 97 having a specific magnetic permeability and a specific electrical resistivity.

As illustrated in FIG. 1, the induction coil 51 is arranged within the distal portion 13 of the device 10, close to the separating wall 40. As described further above, this arrangement provides sufficient shielding of the induction coil 51 from possible stray electromagnetic fields by the device 10 itself. Accordingly, the actual induction process caused by the article 90 when being introduced into the receiving cavity 20 occurs in a well-shielded area under stable, that is, reproducible electromagnetic conditions. Advantageously, this significantly improves the reliability of the article identification as compared to other devices known from prior art. In addition, arrangement of the induction coil 51 in the distal portion 13 of the device 10 allows a complete shielding of the induction coil from the harsh environments in the receiving cavity. Thus, deposits on the induction coil 51 and/or possible corrosion of the electrical parts of the induction coil can be effectively prevented.

In order to concentrate the sensing field of the induction coil 51 to a volume where the effect of the metallic indicator material on the equivalent resistance and equivalent inductance is at maximum, the induction coil 51 is arranged on a magnetic flux concentrator 56 which partially extends into the separating wall 40. Advantageously, this causes the sensing field of the induction coil 51 to be closer to the metallic indicator material in the receiving cavity 20. As can be seen from FIG. 1 and FIG. 2, a distal end 57 of the magnetic flux concentrator 56 ends within the separating wall 40, but does not reach the surface of the separating wall 40 facing the receiving cavity 20.

Figure 5:
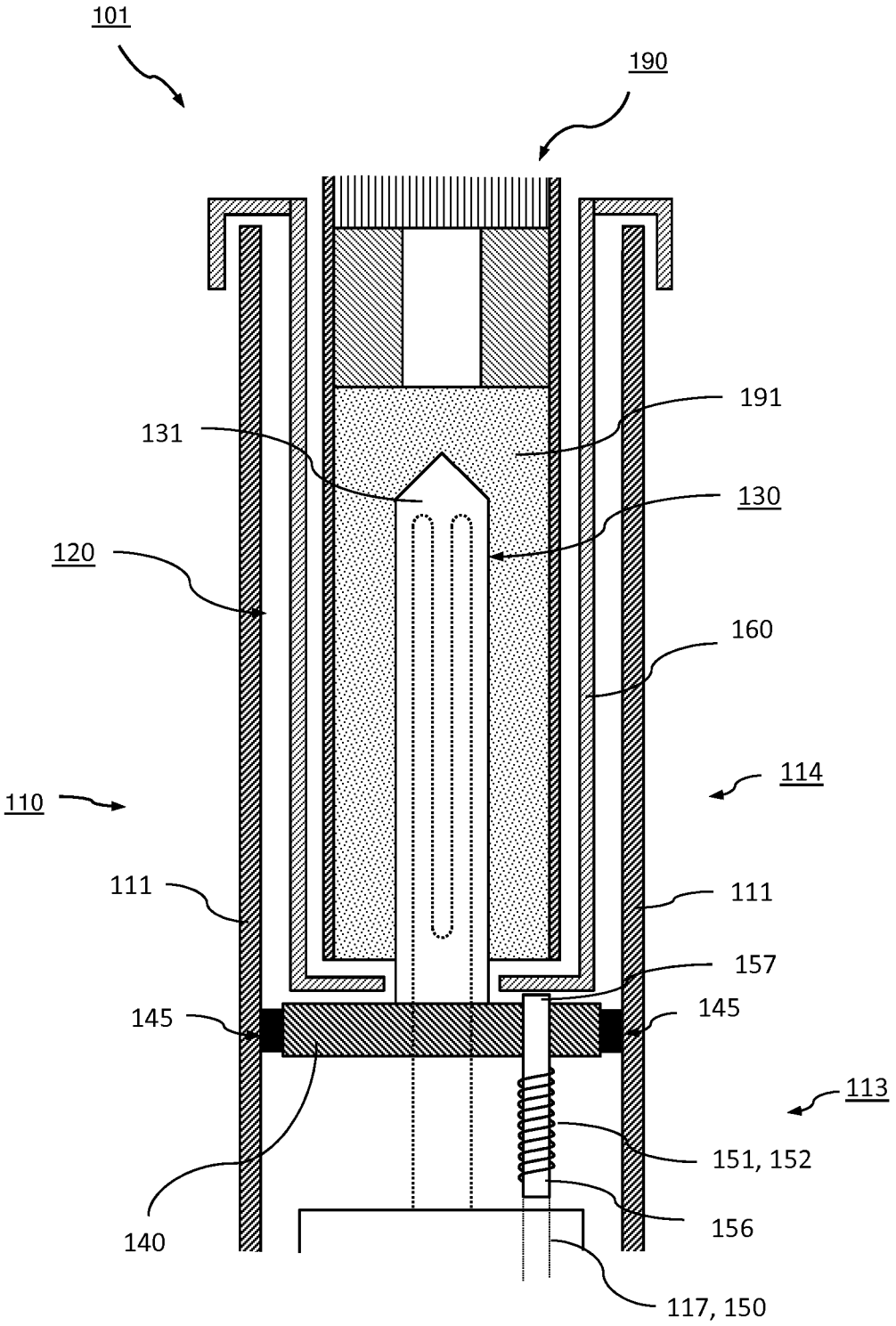
FIG. 5 is a detailed schematic illustration of an aerosol-generating system according to a second embodiment of the present invention.

As an alternative, FIG. 5 schematically illustrates a second embodiment (detail only) of an aerosol-generating system 101 according to the present invention. The system 101 shown in FIG. 5 is very similar to the system 1 shown in FIG. 1 and FIG. 2. The aerosol-generating articles 90, 190 are even identical. Therefore, like or identical features are denoted with the same reference numerals as in FIG. 1 and FIG. 2, incremented by 100. In contrast to the aerosol-generating device 1 according to FIG. 1 and FIG. 2, the device 110 according to FIG. 5 comprises a magnetic flux concentrator 156, the distal end 157 of which extends beyond the separating wall 140 into the proximal portion 114 of the device 110. This configuration allows having the sensing field of the induction coil 151 even closer to the metallic indicator material in the receiving cavity 140. Apart from that, the embodiment of the aerosol-generating system 101 shown in FIG. 5 is identical to the embodiment shown in FIGS. 1 and 2.

In both embodiments shown in FIGS. 1 and 2 and FIG. 5, respectively, the magnetic flux concentrator is a cylinder having a circular or oval cross-section and being made of a ferrimagnetic material, in particular a metallic ferrite such as soft iron.

The invention claimed is:

1. An electrically heatable aerosol-generating device for an aerosol-generating article, the device comprising:

a device housing including a receiving cavity within a proximal portion of the device configured to receive at least a portion of the aerosol-generating article;

a separating wall disposed adjacent to a distal end of the receiving cavity, separating the receiving cavity within the proximal portion of the device from a distal portion of the device;

at least one electrical heating device configured to heat an aerosol-forming substrate within the aerosol-generating article when the article is received in the receiving cavity; and sensing circuitry comprising a field generator disposed within the distal portion of the device adjacent to the separating wall, the sensing circuitry being configured to measure a change of at least one property of the field generator caused by a presence of an indicator arranged within the article when the article is received in the receiving cavity.

2. The electrically heatable aerosol-generating device according to claim 1, further comprising a magnetic flux concentrator, at least a portion of which is circumferentially surrounded by the field generator and disposed within the distal portion of the aerosol-generating device adjacent to the separating wall.

3. The electrically heatable aerosol-generating device according to claim 2, wherein the magnetic flux concentrator extends at least into the separating wall.

4. The electrically heatable aerosol-generating device according to claim 2, wherein the magnetic flux concentrator extends through the separating wall into the proximal portion of the aerosol-generating device.

5. The electrically heatable aerosol-generating device according to claim 2, wherein a thickness of a portion of the separating wall accommodating the magnetic flux concentrator or being adjacent to the magnetic flux concentrator is smaller than a thickness of other portions of the separating wall.

6. The electrically heatable aerosol-generating device according to claim 2, wherein the magnetic flux concentrator comprises a ferrimagnetic material.

7. The electrically heatable aerosol-generating device according to claim 2, wherein the magnetic flux concentrator has a cylindrical shape with a rectangular, quadratic, circular, or oval cross-section.

8. The electrically heatable aerosol-generating device according to claim 2, wherein the magnetic flux concentrator is disposed off-center with respect to a center axis of the receiving cavity.

9. The electrically heatable aerosol-generating device according to claim 1, wherein the field generator is an induction coil.

10. The electrically heatable aerosol-generating device according to claim 9, wherein the induction coil is a helical coil or a flat curved spiral coil.

11. The electrically heatable aerosol-generating device according to claim 1, wherein the at least one property of the field generator is an inductance of the field generator.

12. The electrically heatable aerosol-generating device according to claim 1, further comprising a controller operatively coupled with the sensing circuitry, the controller being configured to control operation of the at least one electrical heating device based on a comparison of a measured change of the at least one property of the field generator with one or more predetermined values of change of the at least one property of the field generator.

13. The electrically heatable aerosol-generating device according to claim 12, wherein the sensing circuitry is further configured to measure a change of at least two properties of the field generator caused by a presence of the indicator within the aerosol-generating article when the article is received in the receiving cavity, and wherein the controller is further configured to control operation of the at least one electrical heating device based on a comparison of a measured change of the at least two properties of the field generator with one or more predetermined values of change of the at least two properties of the field generator.

14. An aerosol-generating system, comprising:

an electrically heatable aerosol-generating device according to claim 1 and an aerosol-generating article for the device, wherein the aerosol-generating article comprises an aerosol-forming substrate, and a wrapper surrounding at least a portion of the aerosol-forming substrate and including an indicator having a specific magnetic permeability and a specific electrical resistivity.

15. The aerosol-generating system according to claim 14, wherein the indicator comprises a thin film or foil made of an electrically conductive material that is applied to at least a portion of an inner surface of the wrapper.

16. The aerosol-generating system according to claim 14, wherein the indicator forms a closed loop electrically conductive path around a circumference of the aerosol-generating article.

17. The aerosol-generating system according to claim 15, wherein the indicator forms a closed loop electrically conductive path around a circumference of the aerosol-generating article.

* * * * *